US008443626B2

(12) United States Patent
Simpson et al.

(10) Patent No.: US 8,443,626 B2
(45) Date of Patent: May 21, 2013

(54) ATTACHMENT FOR FLESH PIERCING JEWELRY

(75) Inventors: Jennifer M. Simpson, Escondido, CA (US); Deborah A. Simpson, Escondido, CA (US); Philip J. Simpson, Escondido, CA (US); Walter Gillespie, Carlsbad, CA (US)

(73) Assignee: Shackles, LLC, Escondido, CA (US)

( * ) Notice: Subject to any disclaimer, the term of this patent is extended or adjusted under 35 U.S.C. 154(b) by 495 days.

(21) Appl. No.: 12/596,982

(22) PCT Filed: Apr. 25, 2008

(86) PCT No.: PCT/US2008/061639

§ 371 (c)(1),
(2), (4) Date: Feb. 26, 2010

(87) PCT Pub. No.: WO2008/134558

PCT Pub. Date: Nov. 6, 2008

(65) Prior Publication Data

US 2010/0147025 A1 Jun. 17, 2010

Related U.S. Application Data

(60) Provisional application No. 60/914,607, filed on Apr. 27, 2007.

(51) Int. Cl.
*A44C 7/00* (2006.01)

(52) U.S. Cl.
USPC ..... 63/12; 63/33; 63/40

(58) Field of Classification Search
None
See application file for complete search history.

(56) References Cited

U.S. PATENT DOCUMENTS

| | | | | |
|---|---|---|---|---|
| 292,810 | A * | 2/1884 | Hartmann | 63/12 |
| 758,848 | A * | 5/1904 | Pejchar | 63/12 |
| 4,195,492 | A | 4/1980 | Johnson | |
| 5,048,310 | A | 9/1991 | Riley | |
| 5,050,404 | A | 9/1991 | Sugerman | |
| RE35,511 | E | 5/1997 | Nakamura | |
| 5,743,113 | A * | 4/1998 | Kogen | 63/12 |
| 7,155,932 | B2 * | 1/2007 | Renter | 63/12 |

OTHER PUBLICATIONS

International Search Report, PCT/US2008/061639, mailed on Nov. 5, 2009.

* cited by examiner

*Primary Examiner* — Jack W. Lavinder
(74) *Attorney, Agent, or Firm* — Knobbe Martens Olson & Bear, LLP

(57) ABSTRACT

Disclosed are methods and devices for attaching an ornamental feature to flesh plugs, flesh tubes, flesh piecing posts and rings, and other piecing jewelry.

13 Claims, 24 Drawing Sheets

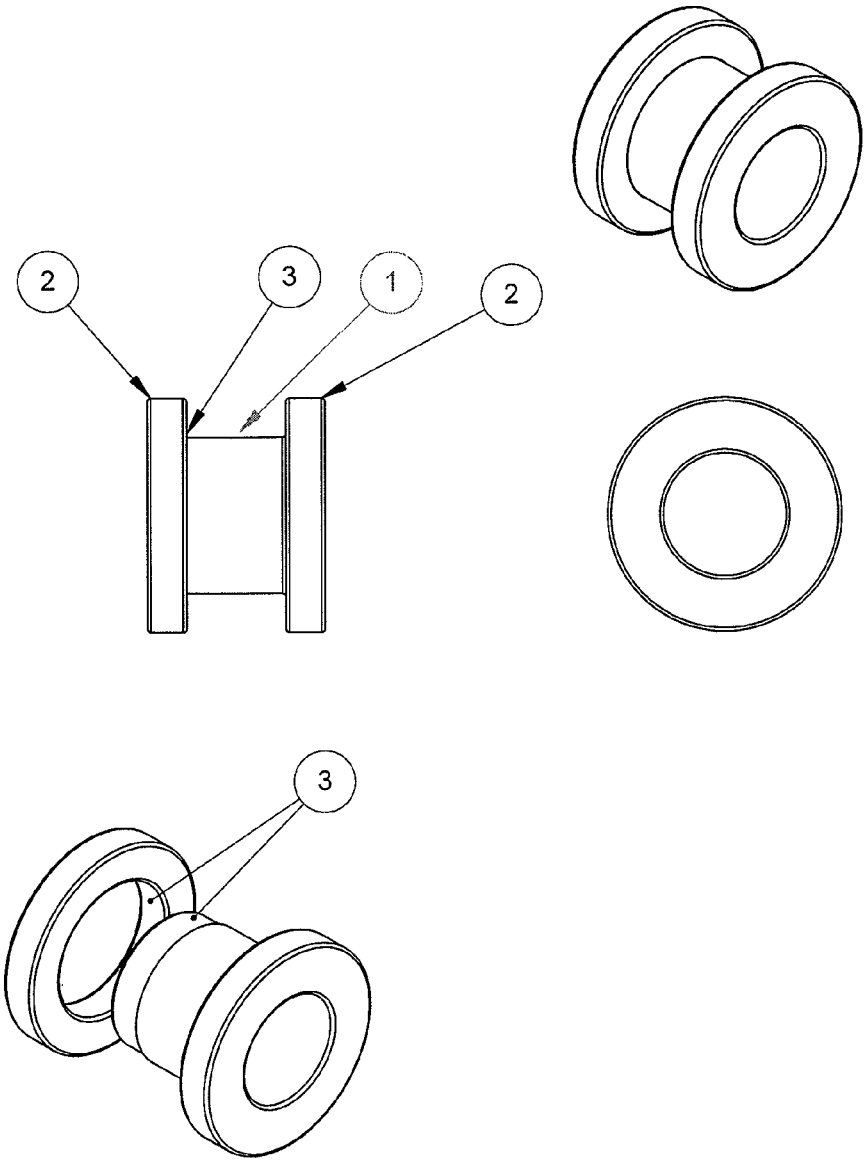
FIG, 1a

BELLY BUTTON RING
WITH CHAIN AND CHARM

BELLYBUTTON RING
WITH LINK AND CHARM

EAR RING POST
WITH CHAIN AND CHARM

EARRING POST
WITH WIRE AND CHARM

PLUG RING WITH
INTEGRATED DECORATION

PLUG RING WITH
INTERGATED "S"
LOGO

DUMBELL SHAPED PLUG
WITH ELASTOMERIC DECORATIVE
ELEMENT

ATTACHMENT FOR FLESH PIERCING JEWELRY

CROSS-REFERENCE TO RELATED APPLICATIONS

This application claims priority under 35 U.S.C. §119 to U.S. Provisional Patent Application Ser. No. 60/914,607, filed Apr. 27, 2007, the disclosure of which is incorporated in its entirety herein by reference.

BACKGROUND OF THE INVENTION

The present invention relates to jewelry for the ear or other flesh piercing jewelry by facilitating the addition of ornamental elements to plugs, tubes, posts, or other flesh piercing jewelry which are placed in a pierced hole and sometime expanded in the ear lobe, eye brow, lip, navel, nose, nipple, etc.

Plugs, Posts, Flesh Tubes and other flesh piercing jewelry are commonly worn in various diameters that vary in diameter from less than one millimeter to sizes as large as desired. Flesh Tubes commonly are designed as a single piece of tube usually with a through hole. Flesh Tubes also generally have flanges on either end to enhance the ability to remain in the hole within the piercing site such as an ear lobe. Some Flesh Tubes are designed to use a removable elastomeric flange such as an o-ring to enhance the ability to remain in the piercing site. Additionally, many Flesh Tubes also are fabricated from two tubular elements that thread together such that they are easier to place in the piercing site. These pieces of jewelry are generally flush with the surface of the piercing site such as the ear and do not posses any dangling elements commonly found in other more conventional jewelry designs.

Conventional post earrings or other piecing jewelry include a wire or post for penetrating skin. A first end of the post is provided with a gemstone or other ornament, and the second end of the post is provided with a removable clasp or anchor. The ornamental component on the jewelry is normally not exchangeable.

It is desired to be able to add ornamentation or a dangling ornamental element to all the aforementioned Flesh Plugs and Flesh Tubes, Posts and all Flesh Piercing Jewelry in general.

SUMMARY OF THE INVENTION

Flesh Plugs and Tubes and piercing devices are generally cylindrical in shape and fabricated from stainless steel. The invention is comprised of a feature or a element added to a standard Flesh Plug or Tube or Piercing Device, which provides a means for attaching dangling ornamentation or otherwise a place to display decoration or ornamentation. The element may be placed on the outside diameter or flange or in some cases replace the inner or outer flange of the Flesh Plug or Tube or Piercing Device. Additionally, an element can be placed in the inside diameter of the Flesh Tube. This inserted element would possess features that allow it to lock securely into the Flesh Tube and possibly a means for attaching dangling ornamentation. A chain or other dangling element would be attached to said means which would terminate with an attachment to any form of ornament. The face of such inserted element could also be used for decorative purposes.

In accordance with another aspect of the present invention, there is provided a device and methods for attaching a second ornamental object to an earring post or other flesh piercing post having a first ornamental object. This enables removable attachment of any of a variety of second ornamental objects to existing earrings or other flesh piercing jewelry.

In one aspect, the invention comprises an ornamental support for attaching an ornament to a flesh piercing device of the type having a flesh piercing post. The support comprises a first connector, configured for attachment to the post on a flesh-piercing device. The first connector may comprise an annular band, defining an aperture for receiving the post. The support additionally comprises a second connector, configured for supporting an ornament from the support.

The first connector may be configured for releasable connection to the post. The second connector may comprise an aperture, a post, a hook, or other attachment structure for supporting an ornament.

In accordance with a further aspect of the present invention, there is provided a method of attaching a second ornamental object to a flesh piercing device of the type having a first ornamental object and a flesh piercing post. The method comprises the steps of providing a flesh piercing device having a post with a first end and a second end, and a first ornamental object on the first end. A support structure is provided, having a first connector configured to attach to the post. The first connector is thereafter attached to the post.

The method may additionally comprise the step of attaching a second ornamental object to the support structure, so that the second ornamental object can hang from the flesh-piercing device. The method may additionally comprise the step of advancing the post through tissue of a wearer so that the first connector is positioned in-between the first ornamental object and the wearer's skin. The attaching the first connector to the post step may comprise advancing the post through an aperture in the support structure.

Further features and advantages of the present invention will become apparent to those of skill in the art in view of the detailed description of preferred embodiments which follows, when considered together with the attached drawings and claims.

BRIEF DESCRIPTION OF THE DRAWINGS

FIG. 1*a* illustrates a conventional flesh tube.

DETAILED DESCRIPTION OF THE PREFERRED EMBODIMENT

Several of the Figures and Embodiments as described below depict application of the proposed devices to a standard ear plug design (1) with rigid front and back flanges (2) on the plug. As shown in FIG. 1A, this is a plug with a screw-together front and back (3). However the application of the proposed devices would work equally well on many other plug, post, or piercing device configurations and designs.

Figure 1B:
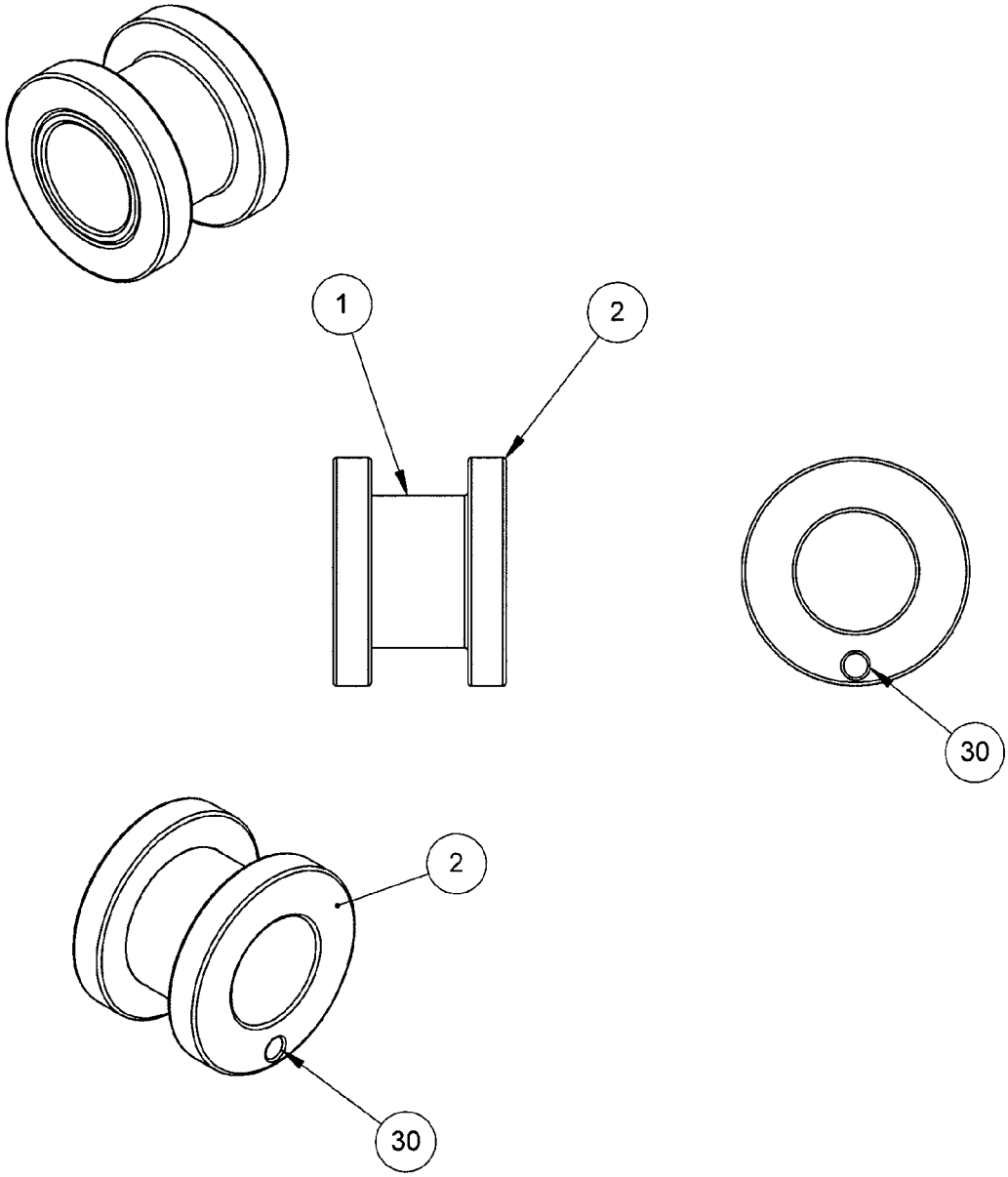
FIG. 1*b* illustrates a flesh tube as in FIG. 1, including an ornamentation hanging feature in accordance with the present invention.

The embodiment in FIG. 1*b* is based on a plug as described above with the addition of an attachment element such as a hole (30) which could be located in the front flange (2) or rear flange or elsewhere on the body (1) which would serve the purpose of hanging chains, decorations, standard pierced ear wires or posts, or other ornaments or jewelry.

Figure 1C:
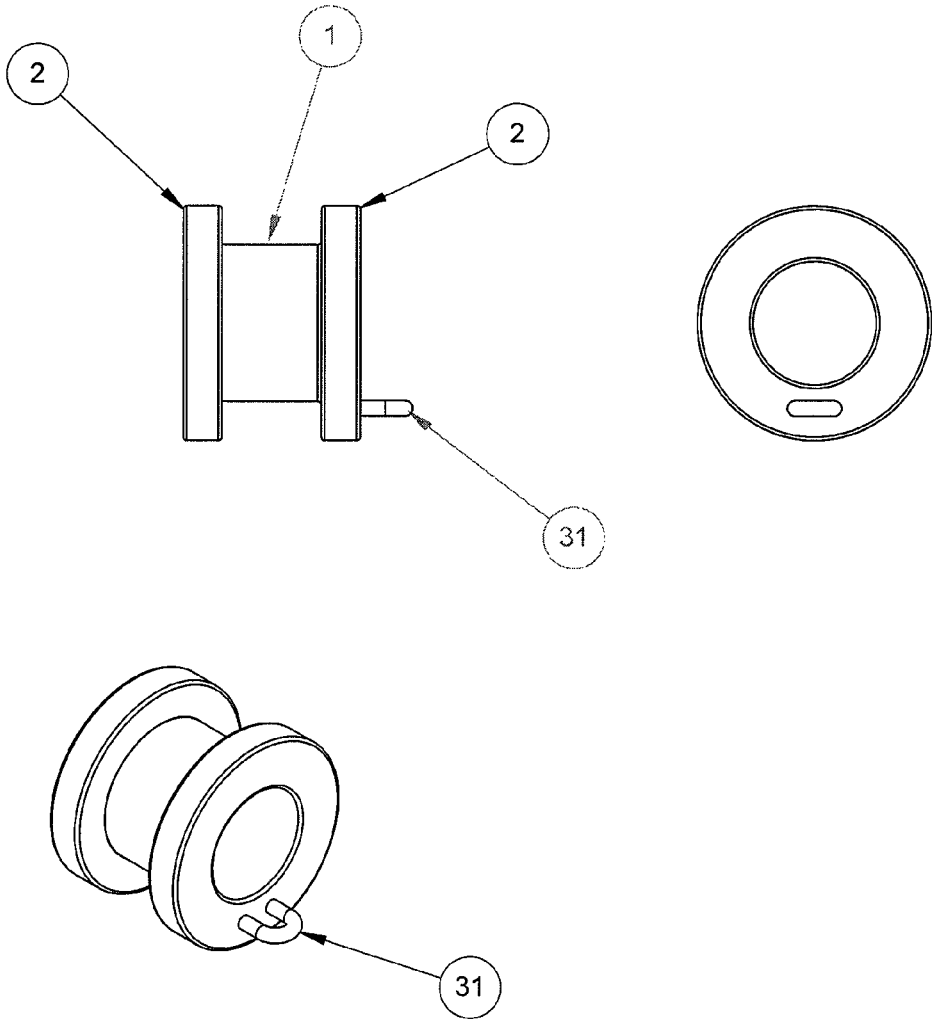
FIG. 1*c* illustrates an alternative ornamentation attachment structure in accordance with the present invention.

Referring to FIG. 1*c*, this embodiment is based on a plug as described above with an integrated feature (31) such as an attachment loop which could be located in the front flange or rear flange (2) or elsewhere on the body (1) which would serve the purpose of hanging chains, decorations, standard pierced ear wires or posts, or other ornaments or jewelry.

Figure 1D:
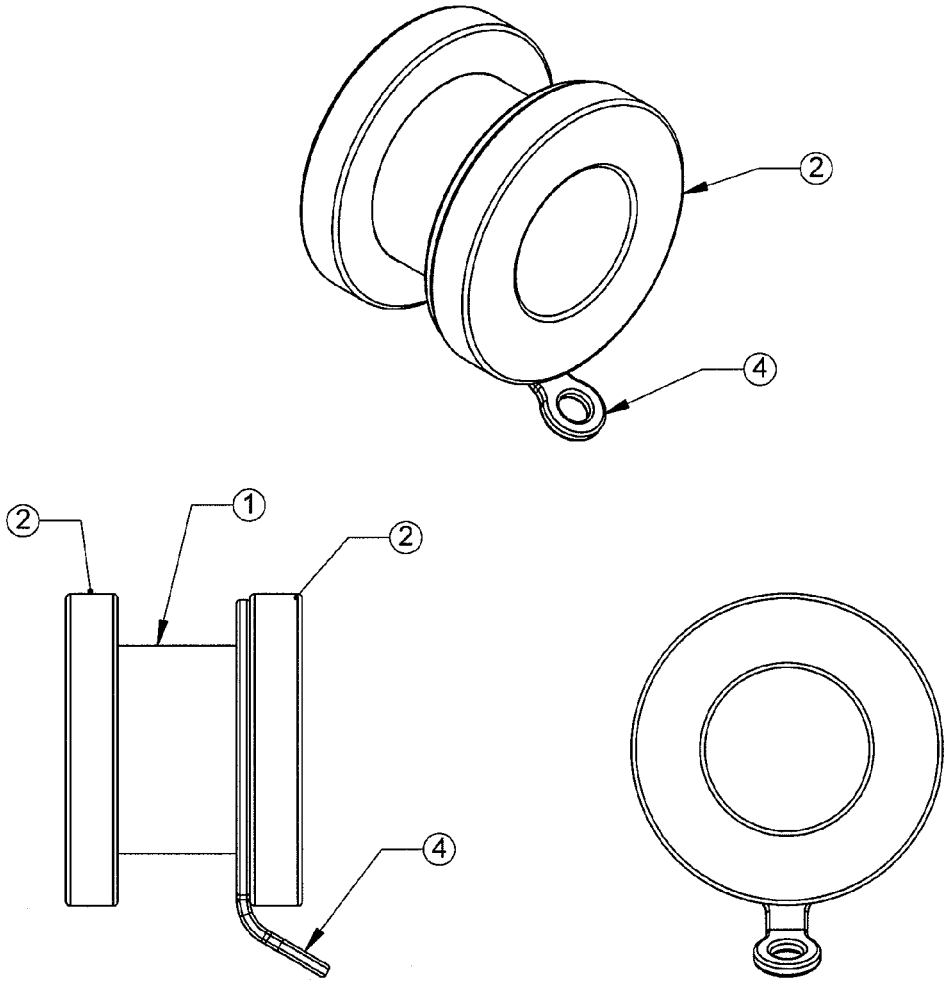
FIG. 1*d* illustrates an alternative ornamentation attachment feature in accordance with the present invention.

Referring to FIG. 1*d*, in this embodiment, the attachment element (4) is a flat tab having an aperture to form an attachment eye, supported by a second, larger ring or washer coaxially carried by the outer diameter of the cylindrical Plug (1) and is contained between the ear and adjacent front or rear flange (2) of the plug, and is shaped and used as a hanging device for chains, decorations, standard pierced ear wires or posts, or other ornaments or jewelry. The second ring may be rotatable or fixed with respect to the body of plug 1.

Figure 2:
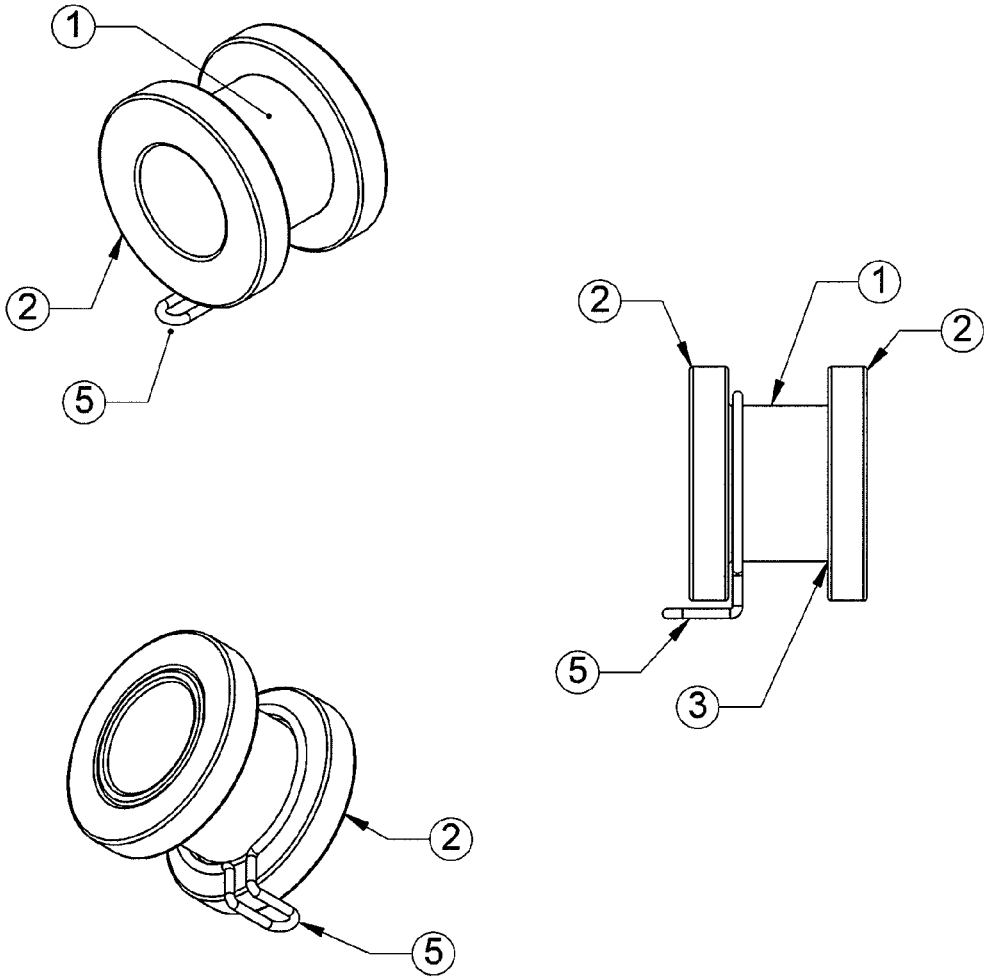
FIG. 2 illustrates an alternative ornamentation attachment structure in accordance with the present invention.

As shown in FIG. 2, this embodiment of the device (5) is a wire-form having a loop which surrounds the tubular body 1 and is contained between the ear and adjacent front or rear flange (2) of the plug, and is shaped with an eye or aperture and used as a hanging device for chains, decorations, standard pierced ear wires or posts, or other ornaments or jewelry.

Figure 3:
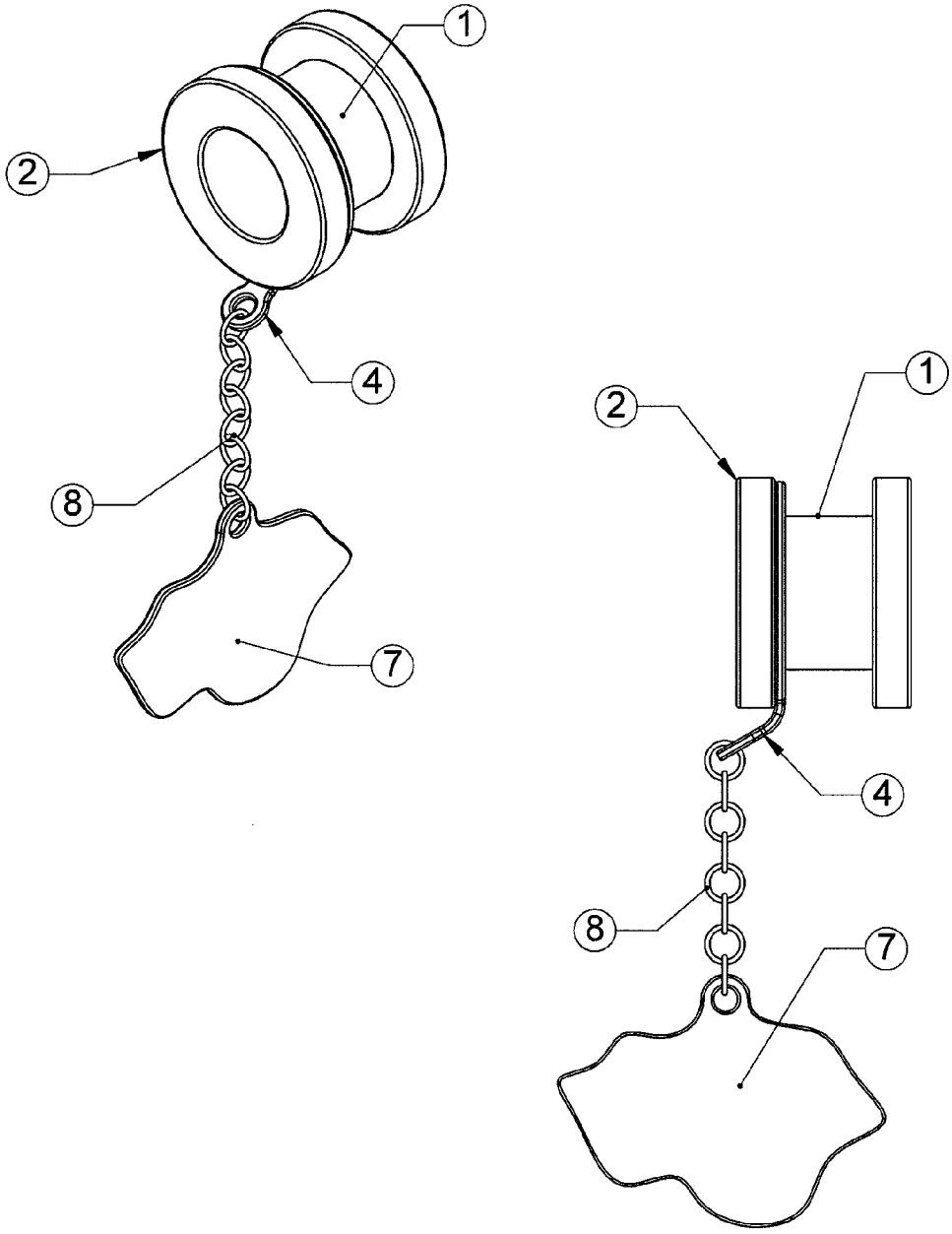
FIG. 3 illustrates an alternative ornamentation attachment structure in accordance with the present invention.

In FIG. 3, this embodiment of the device (4) is contained between the ear and adjacent front or rear flange (2) of the plug, and is shaped and used as a hanging device. This embodiment shows a decoration (7) hanging from the device by a suspension element such as a chain (8).

Figure 4:
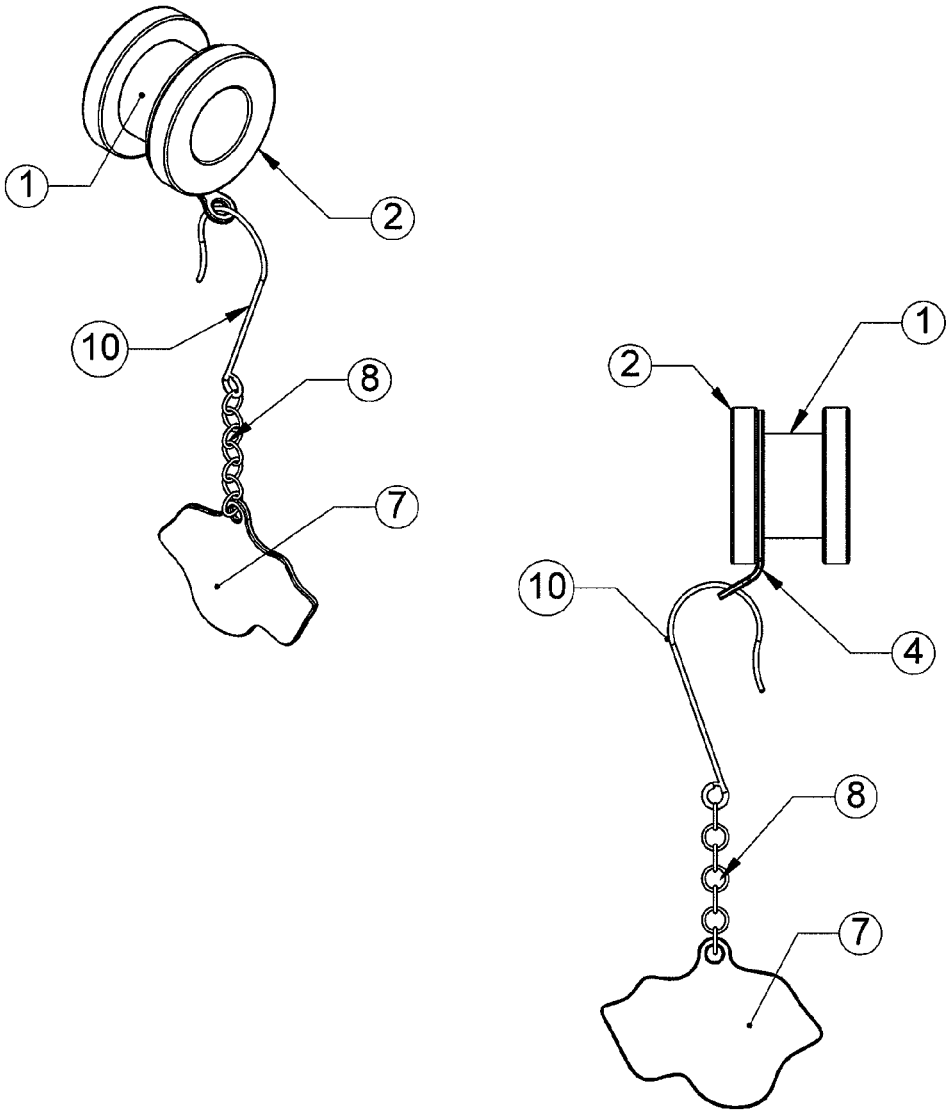
FIG. 4 illustrates an alternative ornamentation attachment feature in accordance with the present invention.

Referring to FIG. 4, this embodiment of the device (4) is contained between the ear and adjacent front or rear flange (2) of the plug, and is shaped and used as a hanging device. This embodiment shows as standard earring wire (10) hooked through an aperture on the device 4, with a decoration (7) removably hanging from the device (4).

Figure 5:
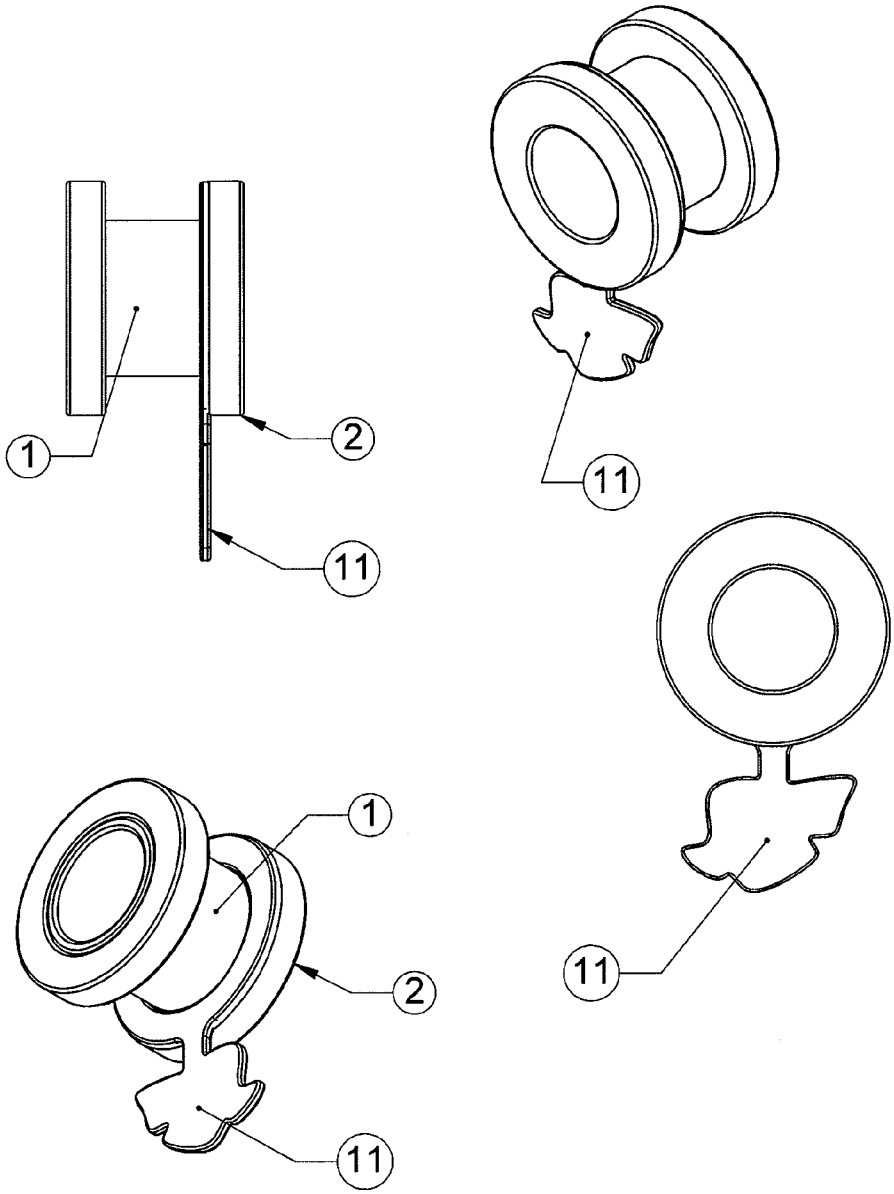
FIG. 5 illustrates an alternative ornamentation attachment structure in accordance with the present invention.

In FIG. 5, the embodiment of the device (11) includes a support ring contained between the ear and adjacent front or rear flange (2) of the plug, and is shaped or is integral with a design or ornament that extends from the support and is visible beyond the boundary of the plug flange.

Figure 6:
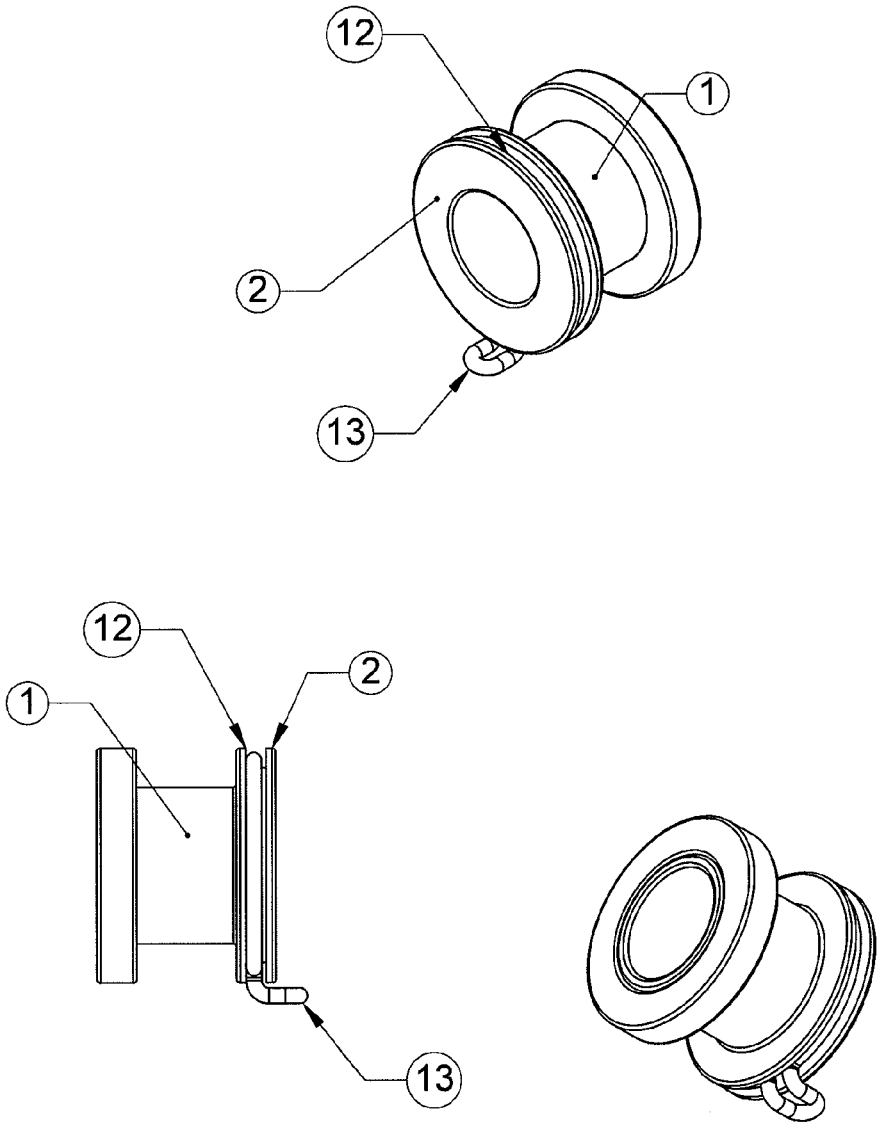
FIG. 6 illustrates an alternative ornamentation attachment structure in accordance with the present invention.

In FIG. 6, the embodiment of the plug (1) has an added radially inwardly extending circumferential groove feature (12) on one flange, for the purpose of containing the support loop portion of a wire device (13) that is shaped and used as a hanging device for chains, decorations, standard pierced ear wires, or other ornaments.

Figure 7:
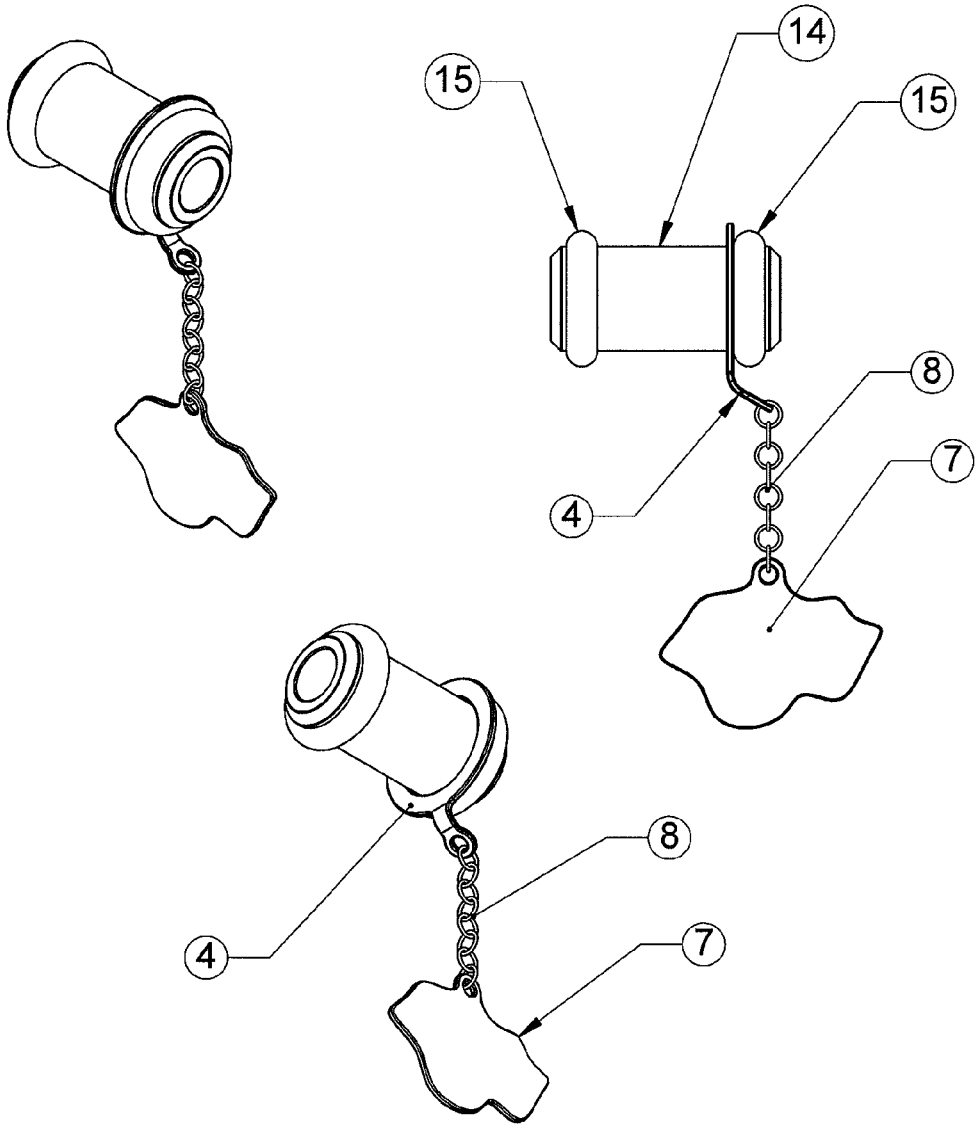
FIG. 7 illustrates an alternative ornamentation attachment structure in accordance with the present invention.

In FIG. 7, this embodiment depicts application of the device to a standard ear plug design (14) with elastomeric o-rings (15) to hold it within the ear. The shown embodiment includes a ring type hanger (4) with a support ring for encircling the cylindrical body of the plug 14 and an attached chain (8) and ornament (7). The embodiment could include all of the other proposed configurations stated within this document for the screw-together type of plug (1), including a wire-form hanger (5), inserts and decorations and methods for attachment to the plug.

Figure 7A:
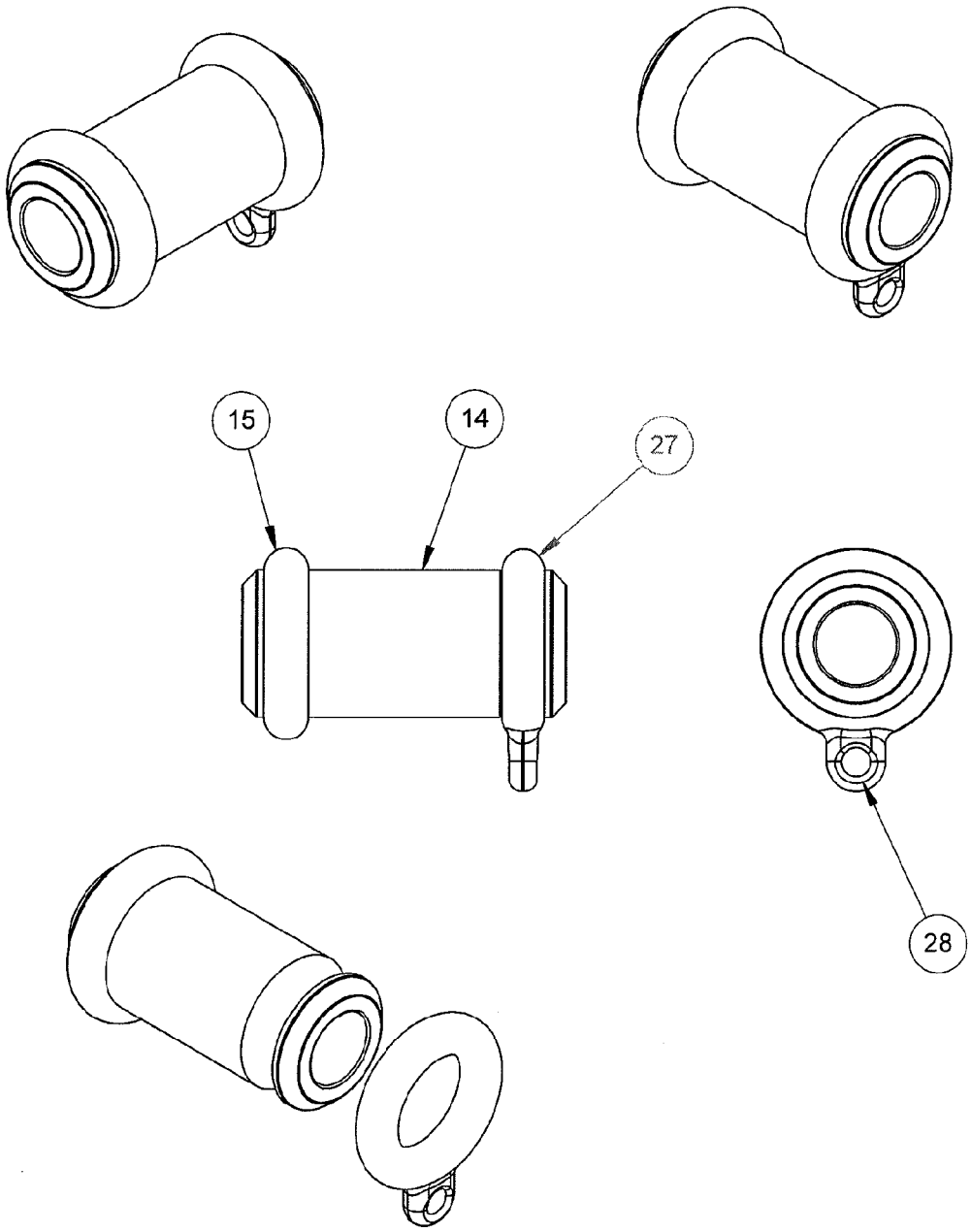
FIG. 7*a* illustrates an alternative ornamentation attachment structure in accordance with the present invention.

In FIG. 7*a*, this embodiment depicts application of the device to a standard ear plug design (14) with an elastomeric o-ring (15) located in a circumferential groove in the rear (medial) portion of the plug and an elastomeric device (27) located in a groove in the front (lateral) portion of the device. The combination of these elastomeric devices is used to hold the plug body within the ear. The front or rear device (27) would also contain a hanger portion (28), which includes an aperture or other attachment structure configured to attach a chain (8) and ornament (7). The device (27) can also be envisioned as a cap which could cover or partially cover the end of the plug. The embodiment could include all of the other proposed configurations stated within this document for the screw-together type of plug (1), including a wire-form hanger (5), inserts and decorations and methods for attachment to the plug.

Figure 7B:
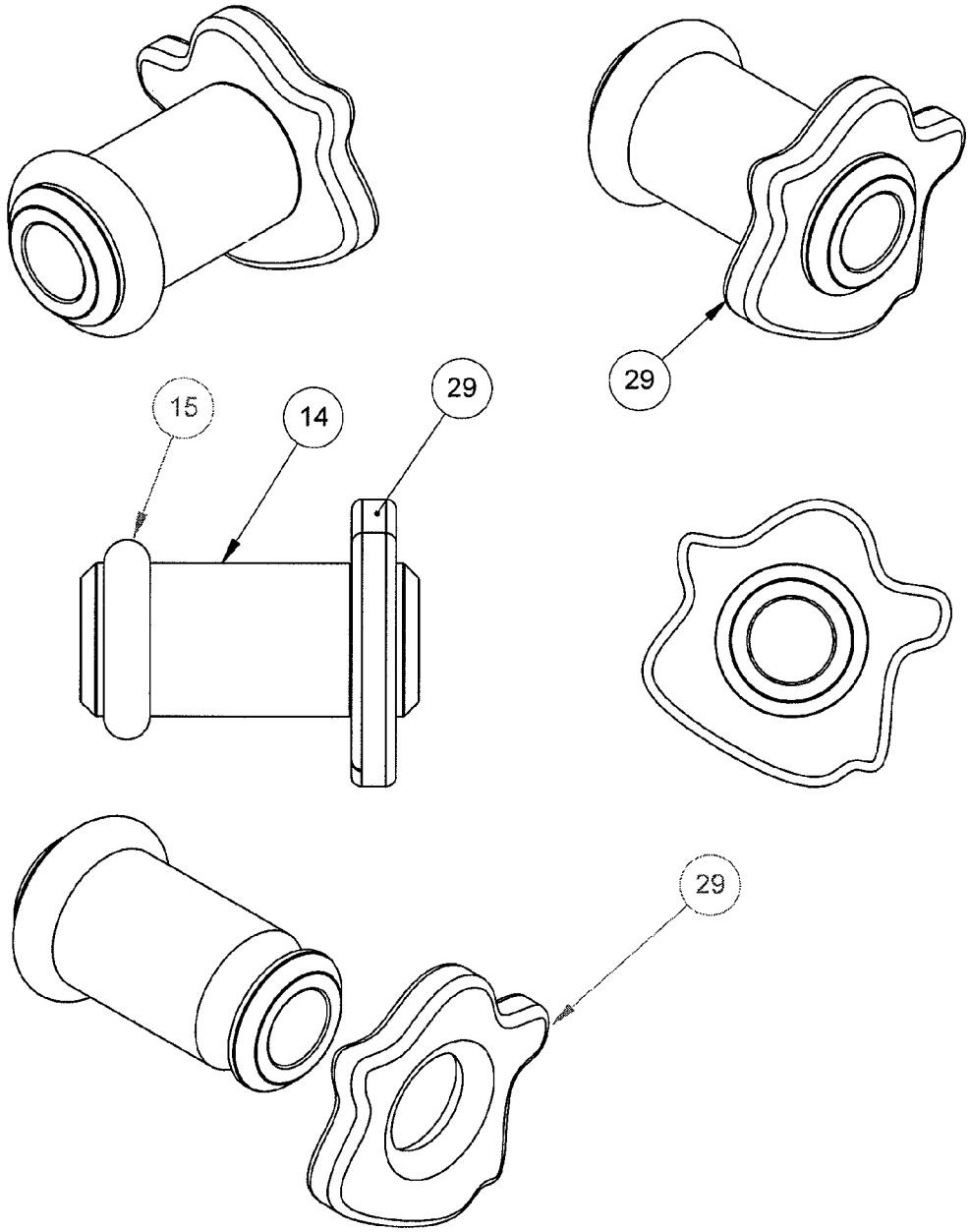
FIG. 7*b* illustrates an alternative ornamentation attachment feature in accordance with the present invention.

In FIG. 7*b*, this embodiment depicts application of the device to a standard ear plug design (14) with an elastomeric o-ring (15) located in a groove in the rear portion of the plug and an elastomeric device (29) located in a groove in the front portion of the device on the front portion of the device. The combination of these elastomeric devices is used to hold the plug body within the ear. The front or rear device (29) could also be ornamental in shape or decorative itself. The device could also have a hanging feature or hole to facilitate the addition of a chain or ornament. The device (29) can also be envisioned as a cap, which could cover or partially cover the end of the plug. The embodiment could include all of the other proposed configurations stated within this document for the screw-together type of plug (1), including a wire-form hanger (5), inserts and decorations and methods for attachment to the plug.

Figure 8:
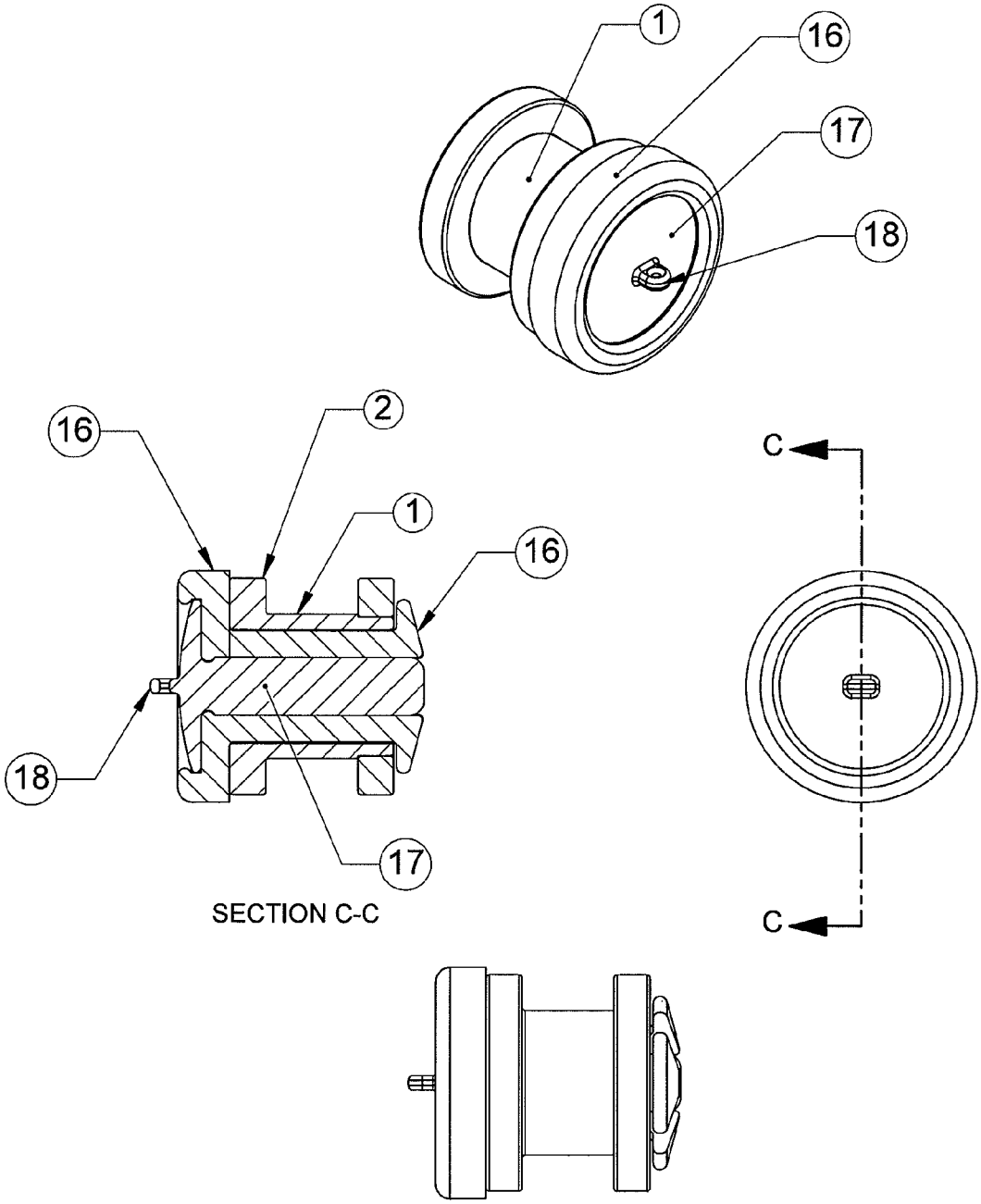
FIG. 8 illustrates an alternative ornamentation attachment structure in accordance with the present invention.

In FIG. 8, this embodiment of the device consists of a flexible insert (16) that can be inserted into the lumen of the plug (1). The insert includes at least one radially outwarding extending retention tab for engaging the medial surface of the body, and is held in place by a center-post (17) with a feature (18) on its face that is shaped and used as a hanging device for chains, decorations, standard pierced ear wires, or other ornaments. The face of the center-post may also be decorative. In other embodiments there could be other methods of holding the decorative center-post within the lumen of the plug.

Figure 9:
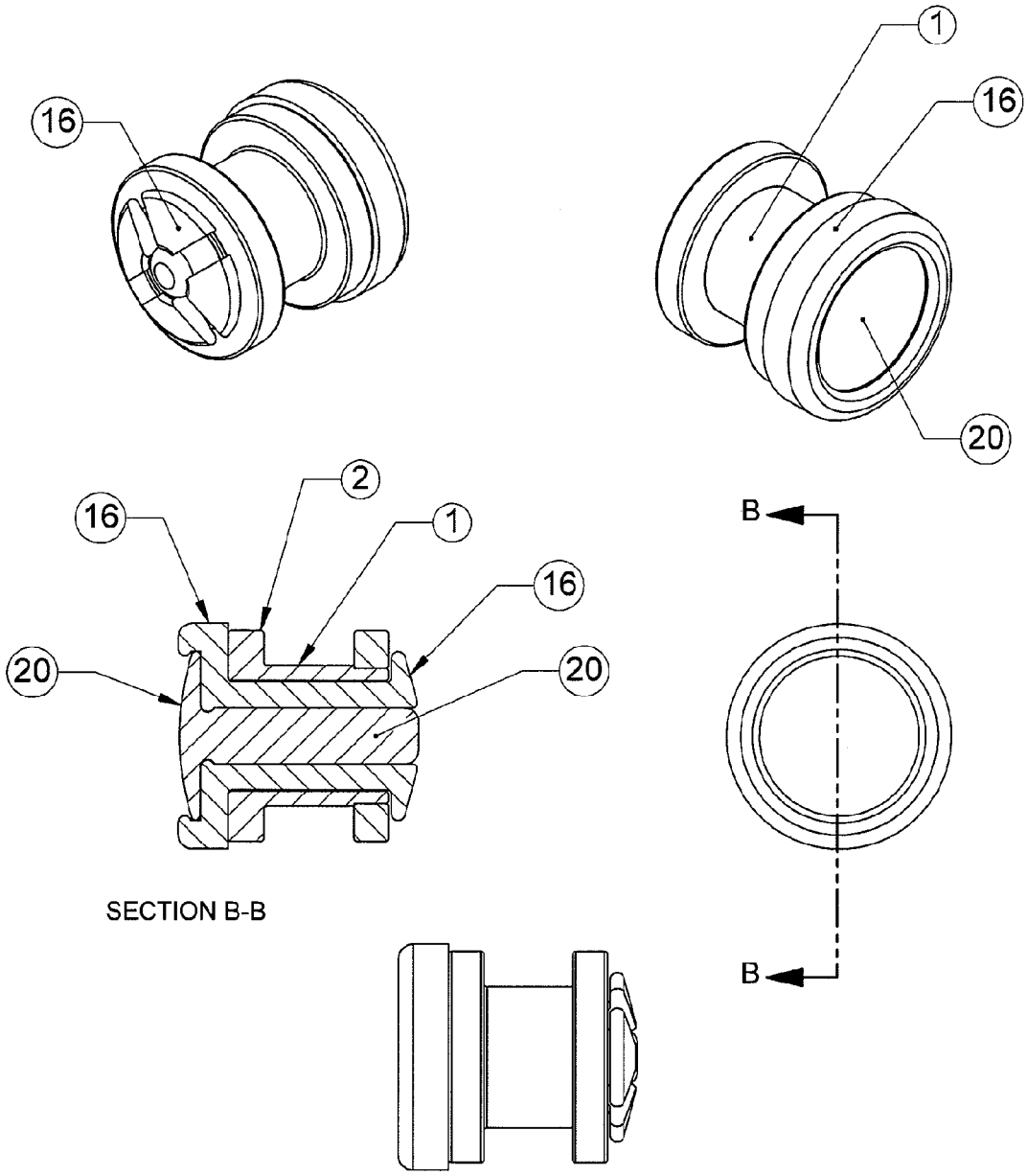
FIG. 9 illustrates an alternative ornamentation attachment structure in accordance with the present invention.

In FIG. 9, this embodiment of the device consists of a flexible insert (16) that can be inserted into the lumen of the plug (1). The insert is held in place by a center-post (20). The face of the center-post is decorative and may contain designs, symbols, logos, jewelry, etc. In other embodiments there could be other methods of holding the decorative center-post within the lumen of the plug. In other embodiments a faceplate without a center-post could be attached to the insert. The faceplate may be decorative and may contain designs, symbols, logos, text, jewelry, etc.

Figure 10:
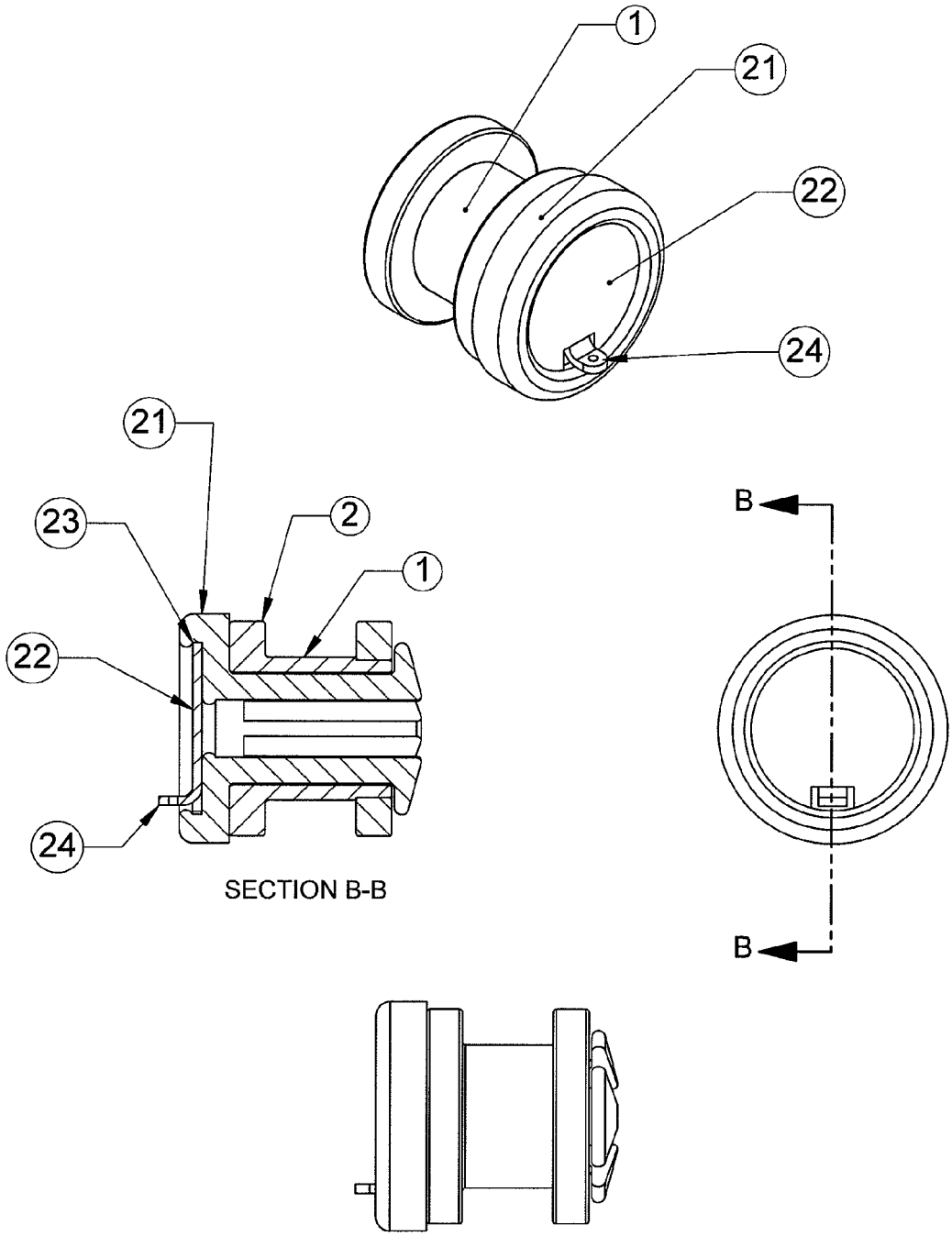
FIG. 10 illustrates an alternative ornamentation attachment structure in accordance with the present invention.

In FIG. 10, this embodiment of the device consists of a flexible insert (21) that can be inserted and secured into the lumen of the plug (1). The insert is held in place by its own flexibility. A faceplate (22) is held in a groove (23) or is otherwise attached to the flexible insert that has a feature (24) shaped and used as a hanging device for chains, decorations, standard pierced ear wires, or other ornaments. The faceplate (22) may be decorative and may contain designs, symbols, logos, text, jewelry, etc.

Figure 11:
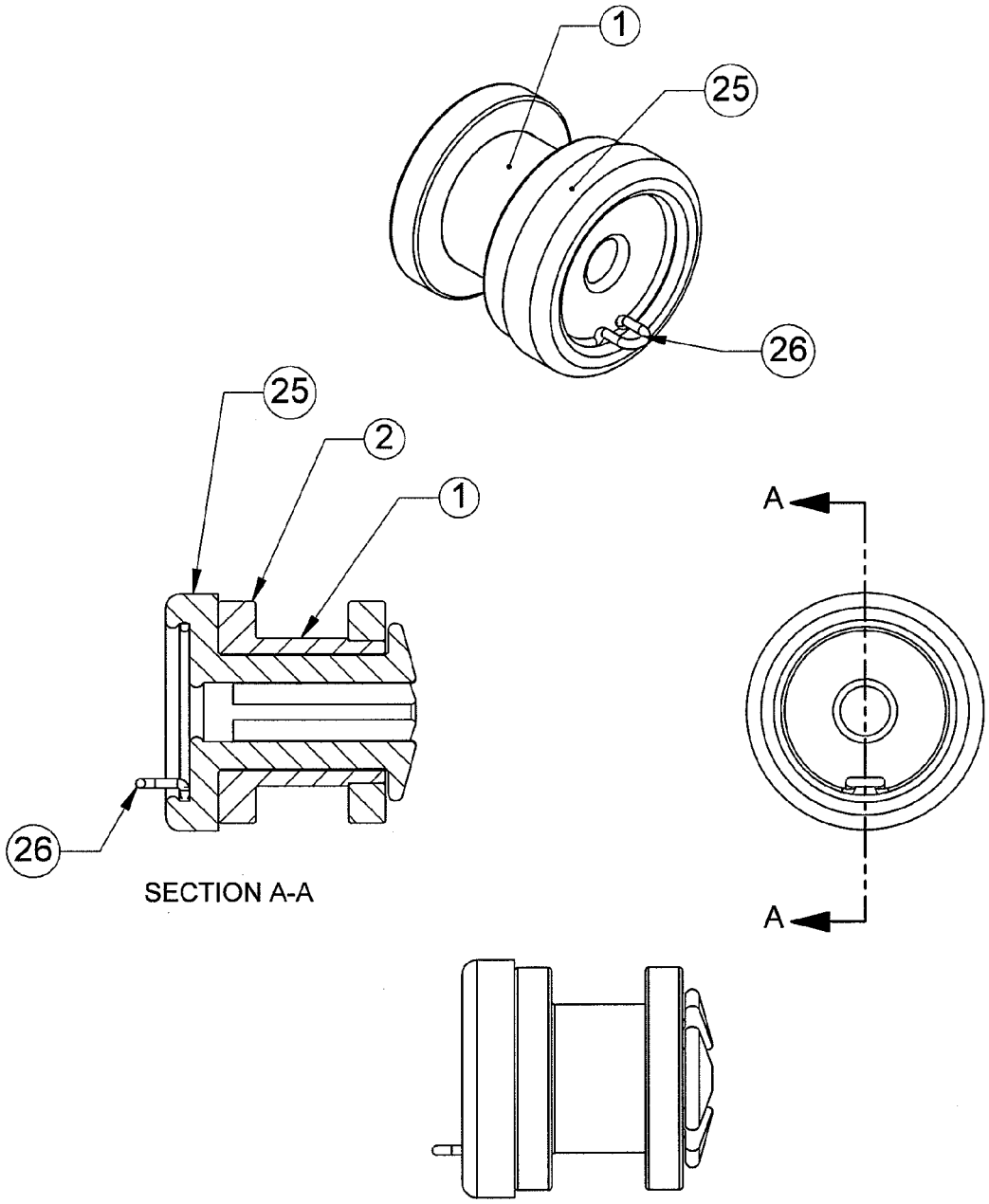
FIG. 11 illustrates an alternative ornamentation attachment structure in accordance with the present invention.

In FIG. 11, this embodiment of the device consists of a flexible insert (25) that can be inserted and secured into the lumen of the plug. The insert (25) is held in place by an interference fit with the plug, and its own flexibility. A wire-form (26) is held in a radially inwardly facing annular groove or is otherwise attached to the flexible insert and is shaped with an eye or other hanging device for chains, decorations, standard pierced ear wires, or other ornaments. There may also be a faceplate that may be decorative and may contain designs, symbols, logos, jewelry, etc.

Figure 12A:
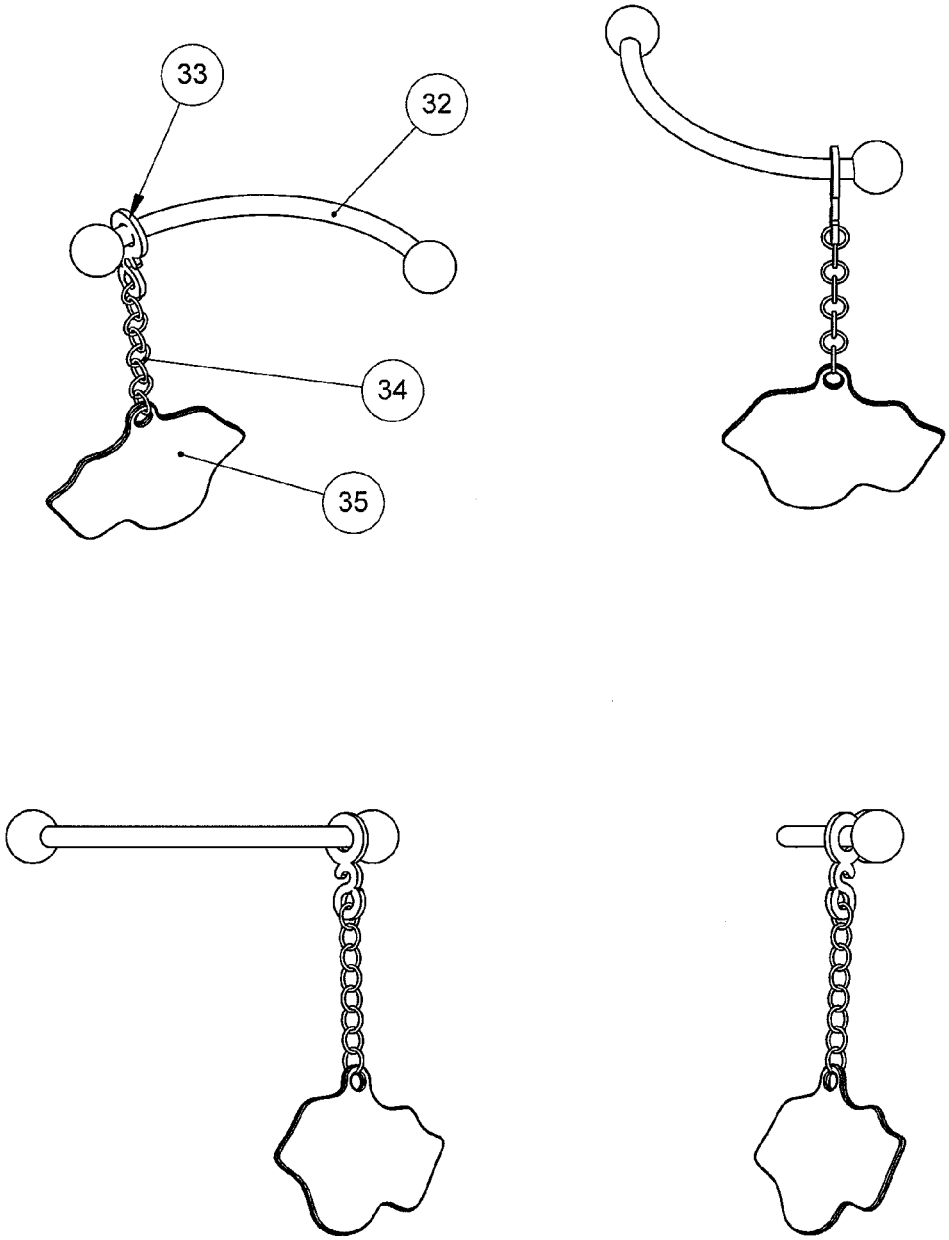
FIG. 12*a* illustrates an alternative ornamentation attachment structure in accordance with the present invention.
Figure 12B:
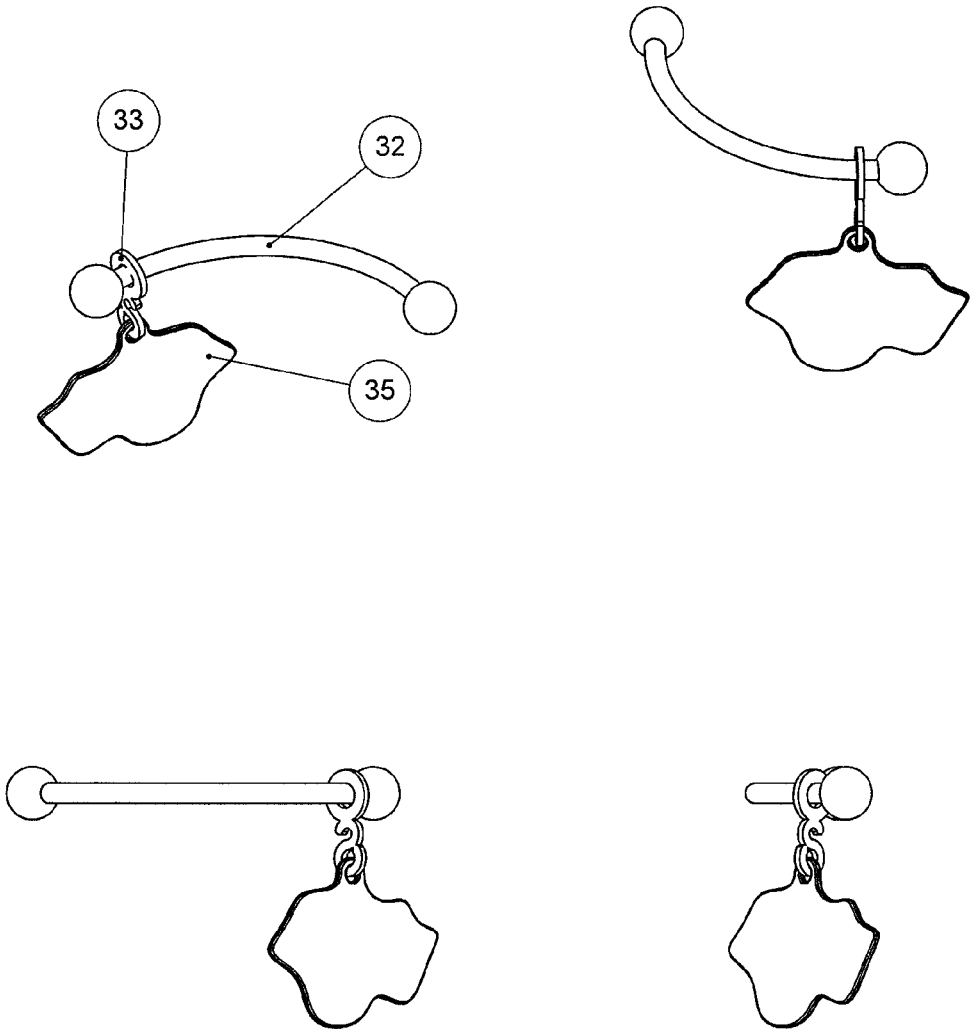
FIG. 12*b* illustrates an alternative ornamentation attachment feature in accordance with the present invention.

FIGS. 12*a* and 12*b*, this embodiment shows the hanging device (33) assemble to an arc or ring (32) which could be used to pierce the navel, eyebrow, lip, nose, nipple, etc. The related ornamentation (35) could be attached directly to the piercing ring with just a link (32) or the addition of a chain (34).

Figure 13A:
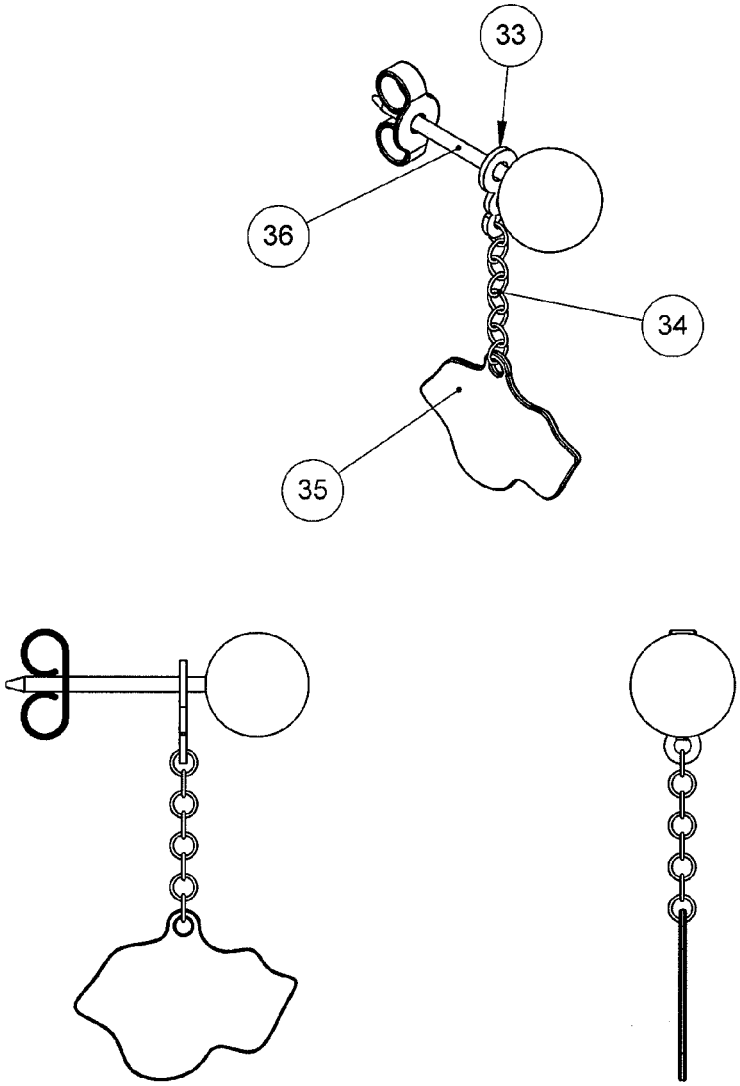
FIG. 13*a* illustrates an alternative ornamentation attachment structure in accordance with the present invention.
Figure 13B:
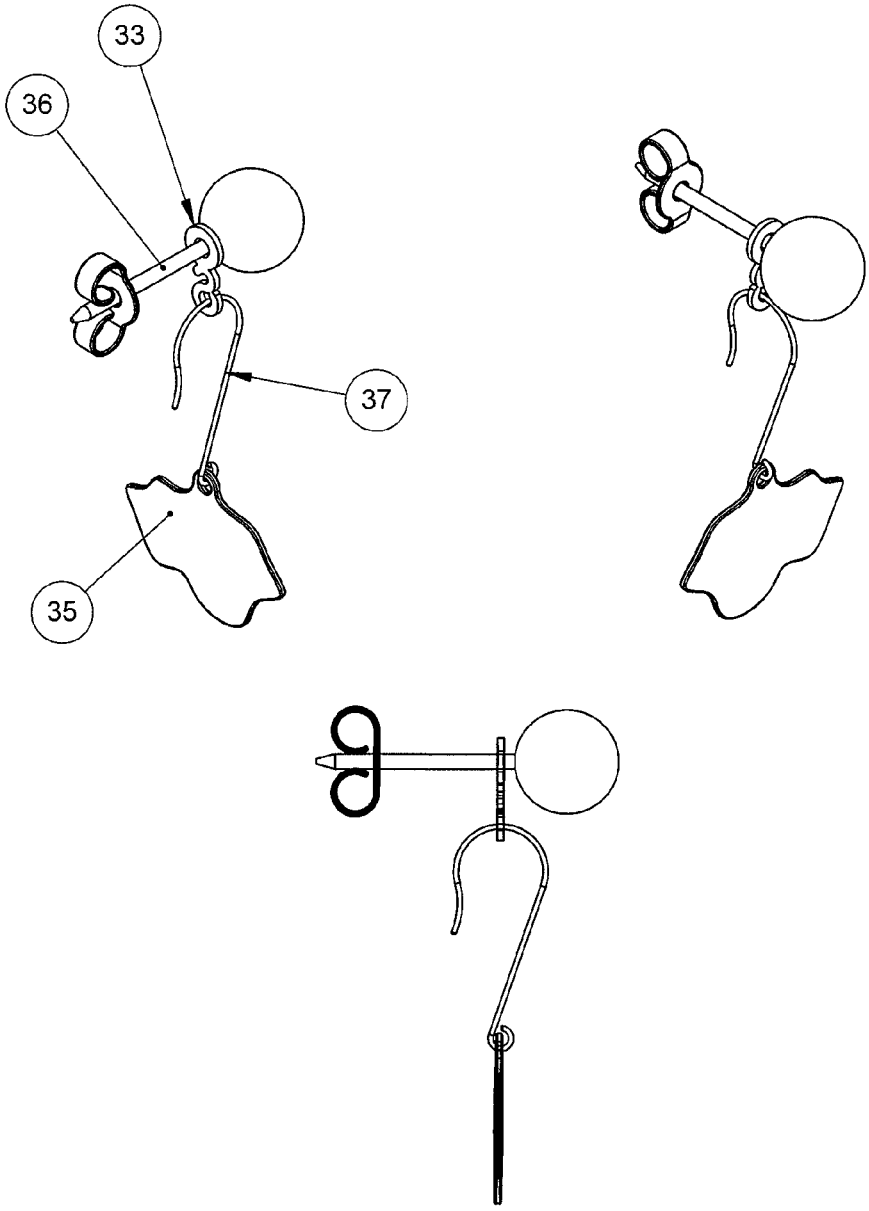
FIG. 13*b* illustrates an alternative ornamentation attachment feature in accordance with the present invention.

FIGS. 13*a* and 13*b*, this embodiment shows the ornamentation (35) added to a standard piercing post (36) such as may be used in the ear or nose, etc. The device includes a first aperture for receiving the post 36 and a second aperture or other attachment structure for receiving a secondary component of jewelry. The device provides a hanger feature which could be used to hang a standard ear ring hook (37) type wire with its associated ornamentation as shown in FIG. 13*b*, or as a hanger with a link (33) or chain (34) to attach the ornamentation as in FIG. 13*a*.

Figure 14A:
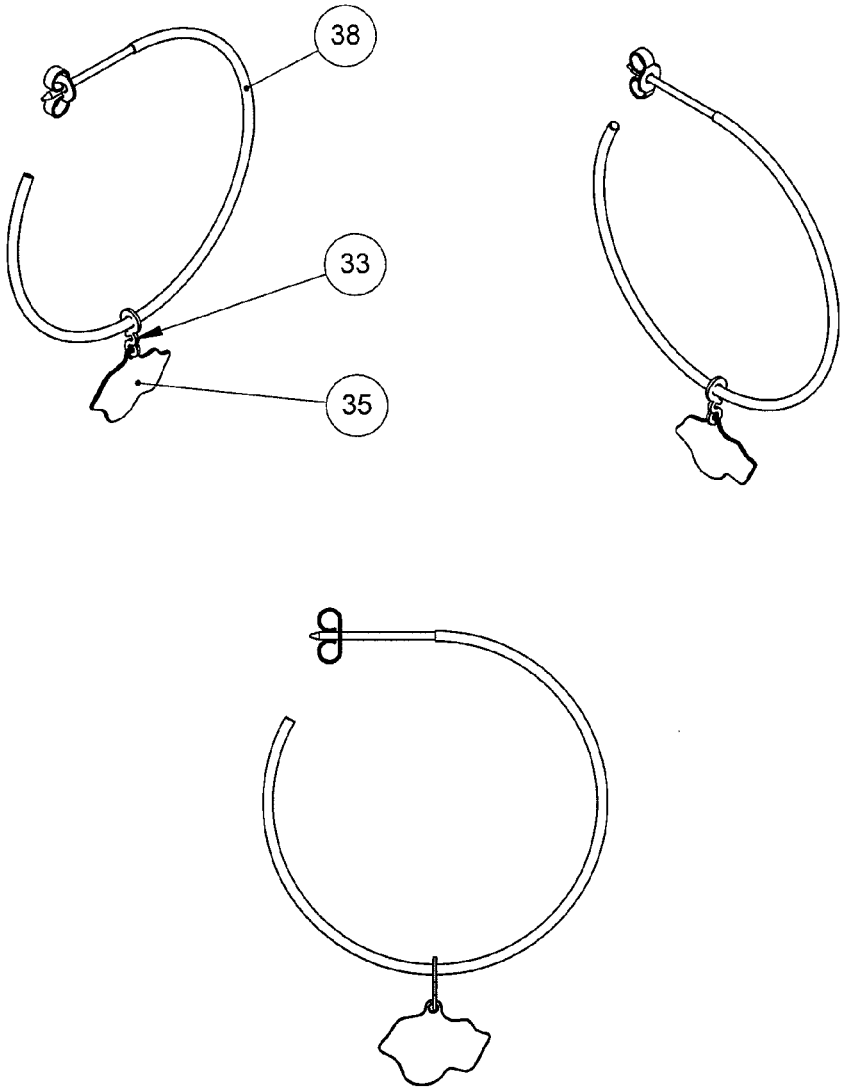
FIG. 14*a* illustrates an alternative ornamentation attachment structure in accordance with the present invention.

FIG. 14*a*, this embodiment shows the ornamentation (35) added to a standard piercing hoop type ear ring (38) such as may be used in the ear or nose, etc. The device may provide a hanger feature that could be used with a link (33) or chain (34) to attach the ornamentation as in FIG. 13*a*.

Figure 15A:
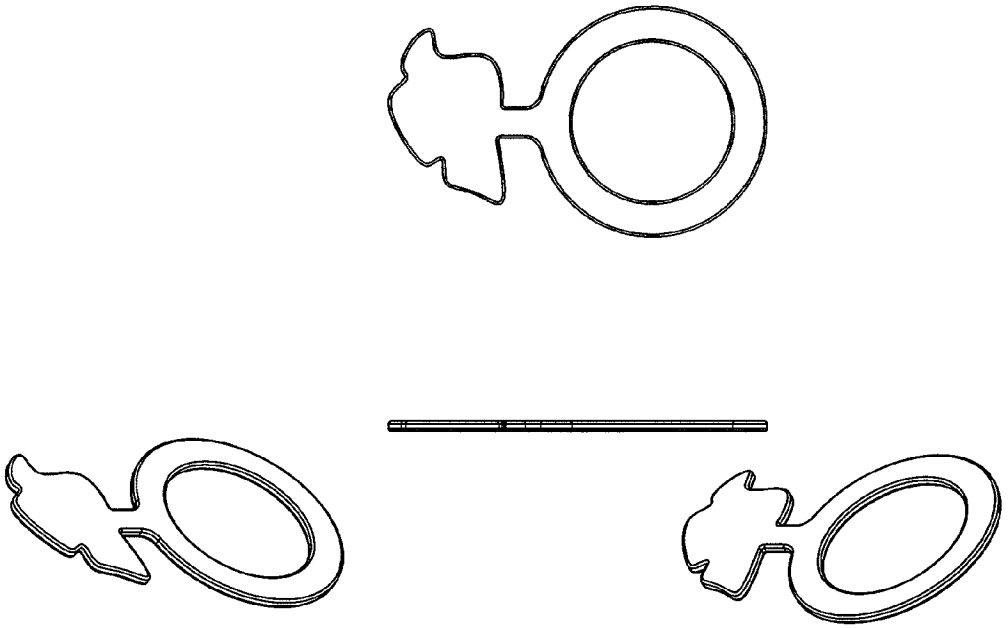
FIG. 15*a* illustrates an alternative ornamentation attachment structure in accordance with the present invention.

FIG. 15*a*, this embodiment shows the plug ring with a decoration integrally attached to the ring.

Figure 16A:
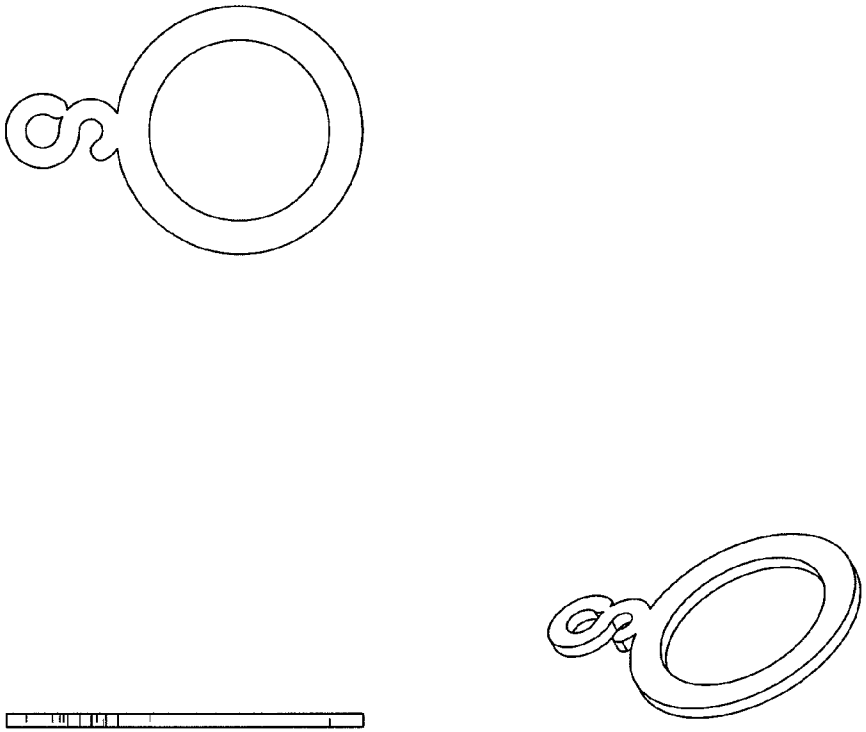
FIG. 16*a* illustrates an alternative ornamentation attachment structure in accordance with the present invention.

FIG. 16*a*, this embodiment shows the plug ring with an integrated design or in this case a logo ("S") that also serves as the hanging feature by which to add a chain or additional ornamentation.

Figure 17A:
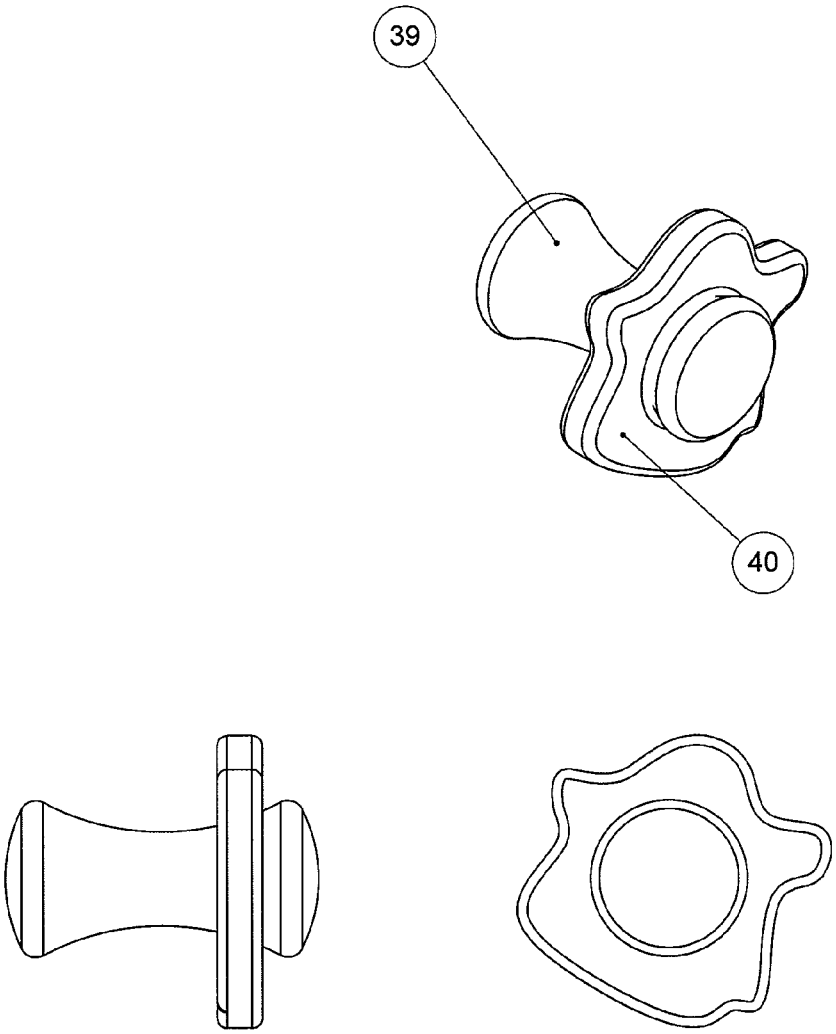
FIG. 17*a* illustrates an alternative ornamentation attachment feature in accordance with the present invention.

FIG. 17*a*, this embodiment shows a dumbbell shaped ear plug (39) onto which an elastomeric device (40) has be stretched over the end and which is either decorative itself or which provides a hanging feature or hole which would allow for the addition of a chain or additional ornamentation as in FIG. 13*a*.

All of the embodiments can be considered independent of the size, gage, shape, or general design of the plug, or other flesh piercing device including methods of attachment or insertion into the piercing site.

All embodiments and components can be considered to be made from a variety of materials including, but not limited to, stainless steel, titanium, silver, gold, fabric, plastics, elastomers, rubber, etc.

All of the embodiments can be considered applicable to any other body modification device besides plugs for ear lobe enlargement, and in particular to any that are used to pierce or enlarge openings in the flesh. This would include standard pierced ear posts, and devices for piercing the navel, eyebrow, nose, lip tongue, nipple, etc.

All of the embodiments contain elements and features that can be mixed and matched to produce any combination or portion of the described embodiments.

All of the above embodiments and features described as being positioned between the front flange and the ear could equally well be positioned between the rear flange and the back of the ear lobe.

All of the embodiments and features for the device could also be envisioned to be added to a standard pierced ear posts, and devices for piercing the navel, eye brow, nose, lip tongue, nipple, etc. for the purpose of adding decoration or ornamentation.

It may also be envisioned that magnets could be used to hold sections of the Flesh Tubes, Plugs, Posts, or other piercing devices together, or to attach the related features or devices used to facilitate the addition of decoration or ornamentation.

Elastomeric devices with decorations or ornamentation, or with features for adding decorations or ornamentation can be applied to any shaped plug or flesh-piercing device.

What is claimed is:

1. A method of attaching a second ornamental object to a flesh piercing device of the type having a first ornamental object and a flesh piercing hollow tube, comprising the steps of:

providing a flesh piercing device having a tube with a first end and a second end and a first ornamental object on the first end;

providing a support structure having a first connector configured to attach to the tube, said first connector comprising an annular band defining an internal aperture; and attaching the first connector to the tube;

advancing the tube through tissue of a wearer so that the first connector is positioned in between the first ornamental object and the wearer's skin;

attaching a second ornamental object to the support structure so that the second ornamental object can hang from the flesh piercing device.

2. The method of claim 1, wherein said flesh piercing device comprises an earring.

3. The method of claim 1, wherein said flesh piercing device comprises an ear plug.

4. The method of claim 1, wherein said flesh piercing device is configured for piercing flesh selected from the group consisting of navel, eye brow, nose, lip, tongue, and nipple.

5. The method of claim 1, wherein said support structure comprises a hook.

6. The method of claim 1, wherein said support structure comprises a ring.

7. A method of attaching a second ornamental object to a flesh piercing device of the type having a first ornamental object and a flesh piercing hollow tube, comprising the steps of:

providing a flesh piercing device having a tube with a first end and a second end and a first ornamental object on the first end;

providing a support structure having a first connector configured to attach to the tube, said first connector comprising an annular band defining an internal aperture; and attaching the first connector to the tube by advancing the tube through the aperture defined by the first connector.

8. The method of claim 7, wherein said flesh piercing device comprises an earring.

9. The method of claim 7, wherein said flesh piercing device comprises an ear plug.

10. The method of claim 7, wherein said flesh piercing device is configured for piercing flesh selected from the group consisting of navel, eye brow, nose, lip, tongue, and nipple.

11. The method of claim 7, wherein said support structure comprises a hook.

12. The method of claim 7, wherein said support structure comprises a ring.

13. The method of claim 7, wherein said support structure is integrated with said second ornamental object.

* * * * *